US005900077A

United States Patent [19]

McVicker et al.

[11] Patent Number: 5,900,077

[45] Date of Patent: *May 4, 1999

[54] HARDNESS, STRENGTH, AND FRACTURE TOUGHNESS STEEL

[75] Inventors: Joseph E. McVicker, Chillicothe; Kenneth W. Burris, Peoria, both of Ill.

[73] Assignee: Caterpillar Inc., Peoria, Ill.

[ * ] Notice: This patent is subject to a terminal disclaimer.

[21] Appl. No.: 08/990,942

[22] Filed: Dec. 15, 1997

[51] Int. Cl.[6] ..... C22C 38/24; C22C 38/28

[52] U.S. Cl. ..... 148/334; 148/328

[58] Field of Search ..... 148/334, 328; 420/110, 111

[56] References Cited

U.S. PATENT DOCUMENTS 5,131,965 7/1992 McVicker ..... 148/334

5,595,614 1/1997 McVicker ..... 148/334

*Primary Examiner*—Deborah Yee

*Attorney, Agent, or Firm*—Kevin M. Kercher

[57] ABSTRACT

A steel article has a composition, by weight percent, including from 0.20 to 0.45 carbon, from 0.4 to 1.5 manganese, from 0.5 to 2.0 silicon, from 0.01 to 2.0 chromium, from 0.15 to 1.2 molybdenum, from 0.01 to 0.40 vanadium, from 0.01 to 0.25 titanium, from 0.005 to 0.05 aluminum, from 0.0001 to 0.010 boron, less than 0.002 oxygen, from 0.005 to about 0.017 nitrogen, and the balance essentially iron. The steel article is free of any detrimental aluminum nitride and has, after quenching and tempering, a fully martensitic microstructure and a controlled distribution of spaced apart micrometer size titanium nitride cuboids and nanometer size background carbonitride precipitates.

17 Claims, 1 Drawing Sheet

HARDNESS, STRENGTH, AND FRACTURE TOUGHNESS STEEL

TECHNICAL FIELD

The present invention relates generally to a deep hardening steel, and more particularly to a deep hardening steel which, after heat treatment, has high hardness, strength and fracture toughness.

BACKGROUND ART

Ground engaging tools, such as, for example, bucket teeth, ripper tips and track shoes, used in construction machines operating in soil and rock, are subject to harsh two body wear. It is necessary for such ground engaging tools to exhibit a combination of high hardness throughout the tool in order for the tool to resist wear, high fracture toughness in order to prevent tool breakage, and sufficient temper resistance in order to prevent loss of hardness during operation at elevated temperatures.

Several steel compositions have been proposed for applications requiring the desirable combination of hardenability, toughness and temper resistance properties. The heretofore disclosed compositions include a relatively high amount of chromium, i.e., above 3% of chromium by weight. For example, a steel composition mainly intended for use as an excavating tool edge material for construction machines is described in U.S. Pat. No. 3,973,951 issued Aug. 10, 1976 to K. Satsumabayashi et al. This steel has a chromium content in the range of 3.0% to 6.0% by weight. Similarly, a wear resisting steel developed for use as a ripper tip material and having chromium in the range of 3.0% to 5.0% by weight is described in Japanese Patent 54-42812 issued Dec. 17, 1979 to Kabushiki Kaisha Komatsu Seisakusho. Another steel intended for use in mining buckets and other mineral processing operations, and having a composition including chromium in the range of 3.0% to 4.5% by weight is described in U.S. Pat. No. 4,170,479 issued Oct. 9, 1979 to G. Thomas et al.

Other heretofore known steels intended for use in applications requiring a combination of high hardenability and toughness require significant amounts of nickel. Examples of these compositions are disclosed in U.S. Pat. No. 2,791,500 issued May 7, 1957 to F. Foley et al, U.S. Pat. No. 3,165,402 issued Jan. 12, 1965 to W. Finkl et al, U.S. Pat. No. 3,379,582 issued Apr. 23, 1968 to H. Dickenson and, more recently, U.S. Pat. No. 4,765,849 issued Aug. 23, 1988 to W. Roberts, which discloses a steel composition having substantially high amounts of aluminum in the range of 0.4% to 1.0% by weight.

U.S. Pat. No. 5,131,965 issued Jul. 21, 1992 to J. McVicker and assigned to the same company as this instant invention, discloses a steel having high hardenability and toughness. However, McVicker uses higher chromium to attain high hardenability and temper resistance.

U.S. Pat. No. 5,595,614 issued Jan. 21, 1997 to J. McVicker and assigned to the same company as this instant invention, discloses a steel having high hardenability and toughness. However, McVicker uses coherent nitride, carbonitride, and carbide particles to attain fracture toughness.

It has been desirable to have a deep hardening steel having a martensitic microstructure having a predetermined and controlled spacing of $\mu$ size titanium nitride cuboids to obtain high fracture toughness. It has also been desirable to have a deep hardening steel that has a microstructure having a predetermined and controlled fine scale distribution of incoherent fine scale (10–400 nanometer size) carbonitrides to improve fracture toughness.

The present invention is directed to overcome one or more of the problems as set forth above.

DISCLOSURE OF THE INVENTION

In one aspect of the invention, a steel article is disclosed. The steel article has a composition, by weight percent, including from 0.20 to 0.45 carbon, from 0.4 to 1.5 manganese, from 0.5 to 2.0 silicon, from 0.01 to 2.0 chromium, from 0.15 to 1.2 molybdenum, from 0.01 to 0.40 vanadium, from 0.01 to 0.25 titanium, from 0.005 to 0.05 aluminum, from 0.0001 to 0.010 boron, less than 0.002 oxygen, from 0.005 to about 0.017 nitrogen, and the balance essentially iron. The steel article is free of any detrimental aluminum nitride and has, after quenching and tempering, a fully martensitic microstructure and a controlled distribution of spaced apart $\mu$ size titanium nitride cuboids and nanometer size background carbonitride precipitates.

In another aspect of the present invention, a steel article has a composition including, by weight percent, from 0.20 to 0.45 carbon, from 0.4 to 1.5 manganese, from 0.50 to 2.0 silicon, from 0.01 to 2.0 chromium, from 0.15 to 1.20 molybdenum, from 0.01 to 0.40 vanadium, from 0.01 to 0.25 titanium, from 0.005 to 0.05 aluminum, from 0.0001 to 0.010 boron, less than 0.002 oxygen, from 0.002 to 0.017 nitrogen, and the balance essentially iron. The steel article has, after quenching and tempering, a hardness of at least $R_c$ 45 measured at the middle of a section having a thickness of no more than 25.4 mm (1 inch), and a plane strain fracture toughness of at least 150 MPa (136 ksi).

In yet another aspect of the present invention, a steel article has a composition including, by weight percent, from 0.20 to 0.45 carbon, from 0.4 to 1.5 manganese, from 0.50 to 2.0 silicon, from 0.01 to 2.0 chromium, from 0.15 to 1.20 molybdenum, from 0.01 to 0.40 vanadium, from 0.01 to 0.25 titanium, from 0.005 to 0.05 aluminum, from 0.0001 to 0.010 boron, less than 0.002 oxygen, from 0.002 to 0.017 nitrogen, and the balance essentially iron, said steel having, after quenching and tempering, a hardness of at least $R_c$ 45 measured at 12.7 mm (0.5 in) below the surface of a section having a thickness greater than 25.4 mm (1 in), and a plane strain fracture toughness of at least 150 MPa (136 ksi).

BEST MODE FOR CARRYING OUT THE INVENTION

Figure 1:
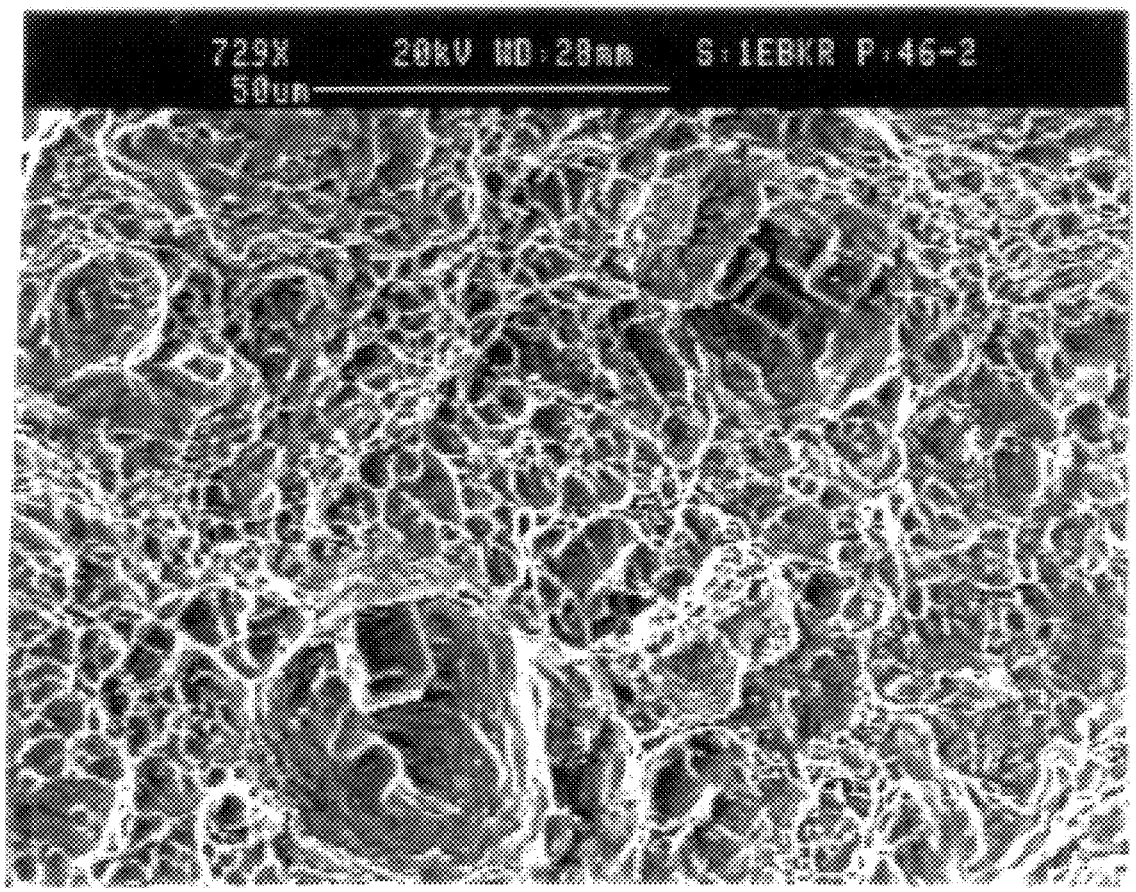
FIG. 1 is a scanning electron microscope (SEM) photograph of a typical fracture surface of a deep hardening steel according to the present invention.

The steel embodying the present invention has high hardenability, toughness, and temper resistance, but contains no more than 2.0% chromium by weight, and preferably between 0.01% and 0.50% chromium.

The steel embodying the present invention does not require the presence of nickel to achieve the desired hardenability and toughness properties.

The present invention discloses the use of controlled amounts of oxygen to obtain optimum spacing of micrometer ($\mu$m) sized, or "$\mu$ size" titanium nitride cuboids to obtain high fracture toughness, as is done in the present invention. In addition, the present invention also discloses the use of controlled amounts of titanium and vanadium to provide a fine scale distribution of fine scale (10–400 nanometer size) carbonitrides to improve fracture toughness.

In the preferred embodiment of the present invention, a steel article has a composition, comprising, by weight percent,

| | |
|---|---|
| carbon | 0.20 to 0.45 |
| manganese | 0.40 to 1.50 |
| silicon | 0.50 to 2.00 |
| chromium | 0.01 to 2.00 |
| molybdenum | 0.15 to 1.20 |
| vanadium | 0.01 to 0.40 |
| titanium | 0.01 to 0.25 |
| aluminum | 0.005 to 0.050 |
| boron | 0.0001 to 0.010 |
| oxygen | 0.002 or less |
| nitrogen | 0.002 to 0.017 |
| iron | essentially balance |

The deep hardening steel of the present invention is essentially free of nickel and copper. However it should be understood that the above described steel composition may contain small quantities of nickel and copper which are not required and are considered incidental. In particular, up to 0.25% nickel and up to 0.35% copper may be present as residual elements in accepted commercial practice.

The term "deep hardening steel" as used herein means a steel having properties that permit a component made thereof to be hardened throughout its cross-section or as nearly throughout as possible. The quantity of manganese, silicon, chromium and molybdenum is in a weight percent such that the high toughness steel article, after quenching and tempering, has a fully martensitic microstructure at a given depth below the surface where high toughness properties are desired.

The term "quenching and tempering" as used herein means a heat treatment which achieves a fully quenched microstructure. For the steel material described in the illustrative Examples described below, the heat treatment specifically includes the following steps:

1. Through heating the test sample to the austenitizing temperature of the steel to produce a homogeneous solution throughout the section without harmful decarburization, grain growth, or excessive distortion. In illustrative Examples A and B, the articles were heated to 870° C. (1598° F.) for about one hour. In the illustrative Examples C, D, E, and F, the articles were heated to about 950° C. (1742° F.) for about one hour.
2. Fully quenched in water to produce the greatest possible depth of hardness.
3. Tempered by reheating for a sufficient length of time to permit temperature equalization of all sections. In the illustrative Examples described below, the articles were reheated to about 200° C. (392° F.) for about one hour. The higher molybdenum contents in illustrative Examples C, D, E, and F require a higher austenitizing temperature to assure alloy carbides are taken into solution prior to quenching.

The fracture toughness of all the Examples described below was measured according to ASTM Test Method E 1304, Standard Test Method for Plane-Strain (Chevron-Notch) Fracture Toughness of Metallic Materials. The specimens for the fracture toughness measurements were all cut from a larger test sample so as to have an L-T orientation with respect to the direction of rolling of the sample source material, as defined by ASTM test method E 399, Test Method for Plane-Strain Toughness of Metallic Materials.

The steel material embodying the present invention is essentially free of aluminum nitrides and has, after quenching and tempering, a fine martensitic microstructure, a controlled distribution of $\mu$ size titanium nitride cuboids, and a controlled distribution of nanometer size carbonitride precipitates.

Further, as shown by the following Examples, the steel material embodying the present invention has improved fracture toughness properties and substantially the same, or better, hardenability when compared with similar prior art steel materials.

EXAMPLE A

An experimental ingot representative of the low end of composition typical of that used by the assignee of the present invention for track shoe and other undercarriage applications, was melted, poured, and rolled to about 7:1 reduction to form a 43 mm (1.7 in) square bar. After rolling, the bar was found, by spectrographic methods, to have the following composition:

| | |
|---|---|
| carbon | 0.22 |
| manganese | 1.08 |
| silicon | 0.23 |
| chromium | 0.51 |
| molybdenum | 0.06 |
| aluminum | 0.036 |
| titanium | 0.042 |
| boron | 0.001 |
| oxygen | 0.003 |
| nitrogen | 0.011 |
| iron | essentially balance |

After rolling, three 25.4 mm (1 in) diameter short rod fracture toughness test specimens were machined from bar in accordance with ASTM E1304 having L-T orientation as described in ASTM E399. The fracture toughness test specimens were heat treated according to the above defined quench and temper operation to obtain a fully martensitic microstructure, tested in accordance with ASTM E1304 and found to have the following properties:

| | |
|---|---|
| Hardness $R_C$ | 48 |
| Fracture Toughness $K_{1V}$ | 122 Mpa (111 ksi) |

Hardness measurements were made on each of the test specimens at a point about 12.7 mm (0.5 in) below the grip slot face end of the short rod specimens. The fracture toughness value was calculated as the average value of the three short rod specimens tested.

EXAMPLE B

An experimental ingot representative of the high end of composition typical of that used by the assignee of the present invention for track shoe and other undercarriage applications, was melted, poured, and rolled to about 7:1 reduction to form a 43 mm (1.7 in) square bar. After rolling, the bar was found, by spectrographic methods, to have the following composition:

| | |
|---|---|
| carbon | 0.28 |
| manganese | 1.28 |
| silicon | 0.24 |
| chromium | 0.61 |
| molybdenum | 0.11 |

-continued

| | |
|---|---|
| aluminum | 0.036 |
| titanium | 0.043 |
| boron | 0.001 |
| oxygen | 0.002 |
| nitrogen | 0.011 |
| iron | essentially balance |

After rolling, three 25.4 mm (1 in) diameter short rod fracture toughness test specimens were machined from bar in accordance with ASTM E1304 having L-T orientation as described in ASTM E399. The fracture toughness test specimens were heat treated according to the above defined quench and temper operation to obtain a fully martensitic microstructure, tested in accordance with ASTM E1304 and found to have the following properties:

| | |
|---|---|
| Hardness $R_C$ | 51 |
| Fracture Toughness $K_{1V}$ | 100 Mpa (91 ksi) |

Hardness measurements were made on each of the test specimens at a point about 12.7 mm (0.5 in) below the grip slot face end of the short rod specimens. The fracture toughness value was calculated as the average value of the three short rod specimens tested.

EXAMPLE C

An experimental ingot, representative of the deep hardening steel embodying the present invention, was melted, poured, and rolled to about 7:1 reduction to form a 43 mm (1.7 in) square bar.

Importantly, in the preparation of this melt, the titanium addition was made in the ladle concurrently with the addition of aluminum. It has been discovered that the addition of titanium must be made concurrently with, or later than, the aluminum addition. Titanium has a stronger affinity for nitrogen than aluminum and, protects aluminum from nitrogen and, thus, preclude the possibility of forming undesirable aluminum nitride which has a negative effect on fracture toughness. The early, or concurrent, addition of aluminum is necessary to protect the titanium from oxygen. Aluminum is a thermodynamically stronger oxide former than titanium at liquid steel temperatures. Thus, in the present invention, the formation of undesirable aluminum nitride is prevented.

The presence of nitride forming element titanium in the presence of nitrogen provides the opportunity to form $\mu$ size titanium nitride cuboids in the melt which nucleate on aluminum oxide precipitates. The spacing of these cuboids is controlled by the number of aluminum oxide particles that form in the melt. The amount of aluminum and oxygen in the melt control the number of aluminum oxide particles that form.

The presence of carbonitride forming elements vanadium and titanium, in the presence of nitrogen and carbon, provides the opportunity of precipitating nanometer size vanadium titanium carbonitrides as the solid steel cools to room temperature and during subsequent heat treatment.

It is believed that the significantly higher fracture toughness observed for the steel that represents the present invention is the result of freedom from aluminum nitrides, the controlled distribution of titanium nitride cuboids surrounded locally by a interstitial depleted region to promote free dislocation movement, and a controlled distribution of nanometer size carbonitride precipitates surrounded locally by a interstitial depleted region to promote free dislocation movement. Interstitial elements in body centered cubic (or body centered tetragonal) steel microstructures include small elements boron, carbon, nitrogen and oxygen.

The steel from this ingot was spectrographically analyzed and had the following composition:

| | |
|---|---|
| carbon | 0.24 |
| manganese | 0.74 |
| silicon | 1.05 |
| chromium | 0.11 |
| molybdenum | 0.30 |
| aluminum | 0.016 |
| titanium | 0.044 |
| vanadium | 0.10 |
| boron | 0.002 |
| oxygen | 0.0009 |
| nitrogen | 0.010 |
| iron | essentially balance |

After rolling, three 25.4 mm (1 in) diameter short rod fracture toughness test specimens were machined from bar in accordance with ASTM E1304 having L-T orientation as described in ASTM E399. The fracture toughness test specimens were heat treated according to the above defined quench and temper operation to obtain a fully martensitic microstructure, tested in accordance with ASTM E1304 and found to have the following properties:

| | |
|---|---|
| Hardness $R_C$ | 48 |
| Fracture Toughness $K_{1V}$ | 191 Mpa (174 ksi) |

Hardness measurements were made on each of the test specimens at a point about 12.7 mm (0.5 in) below the grip slot face end of the short rod specimens. The fracture toughness value was calculated as the average value of the three short rod specimens tested. Fracture surfaces from the fracture surfaces of short rod fracture toughness specimens were examined by SEM (scanning electron microscope) techniques. No aluminum nitrides were observed in any specimen. The fracture surfaces all showed predominantly large ductile primary voids having a diameter approximately in the range of about 20 $\mu$ to about 30 $\mu$ surrounding the titanium nitride cuboids and relatively coarse ductile dimples spaced in the range of about 1.0 nanometers to about 1.5 nanometers, and mostly at about 1.2 nanometers. This is believed to occur due to microvoid nucleation and growth.

EXAMPLE D

An experimental ingot, representative of the deep hardening steel embodying the present invention, was melted, poured, and rolled to about 7:1 reduction to form a 43 mm (1.7 in) square bar similar to the experimental ingot of Example C. In the preparation of this melt, the titanium addition was made in the ladle concurrently with the addition of aluminum. The steel from this ingot was spectrographically analyzed and had the following composition:

| | |
|---|---|
| carbon | 0.29 |
| manganese | 0.74 |
| silicon | 0.51 |
| chromium | 0.31 |
| molybdenum | 0.52 |
| aluminum | 0.029 |
| titanium | 0.045 |

-continued

| | |
|---|---|
| vanadium | 0.096 |
| boron | 0.001 |
| oxygen | 0.002 |
| nitrogen | 0.012 |
| iron | essentially balance |

After rolling, three 25.4 mm (1 in) diameter short rod fracture toughness test specimens were machined from bar in accordance with ASTM E1304 having L-T orientation as described in ASTM E399. The fracture toughness test specimens were heat treated according to the above defined quench and temper operation to obtain a fully martensitic microstructure, tested in accordance with ASTM E1304 and found to have the following properties:

| | |
|---|---|
| Hardness $R_C$ | 50 |
| Fracture Toughness $K_{1V}$ | 173 Mpa (158 ksi) |

EXAMPLE E

An experimental ingot, representative of the deep hardening steel embodying the present invention, was melted, poured, and rolled to about 7:1 reduction to form a 43 mm (1.7 in) square bar similar to the experimental ingot of Example C. In the preparation of this melt, the titanium addition was made in the ladle concurrently with the addition of aluminum. The steel from this ingot was spectrographically analyzed and had the following composition:

| | |
|---|---|
| carbon | 0.29 |
| manganese | 0.71 |
| silicon | 0.49 |
| chromium | 0.31 |
| molybdenum | 0.52 |
| aluminum | 0.030 |
| titanium | 0.043 |
| vanadium | 0.10 |
| boron | 0.0014 |
| oxygen | 0.001 |
| nitrogen | 0.009 |
| iron | essentially balance |

After rolling, three 25.4 mm (1 in) diameter short rod fracture toughness test specimens were machined from bar in accordance with ASTM E1304 having L-T orientation as described in ASTM E399. The fracture toughness test specimens were heat treated according to the above defined quench and temper operation to obtain a fully martensitic microstructure, tested in accordance with ASTM E1304 and found to have the following properties:

| | |
|---|---|
| Hardness $R_C$ | 50 |
| Fracture Toughness $K_{1V}$ | 174 MPa (158 ksi) |

EXAMPLE F

An experimental ingot, representative of the deep hardening steel embodying the present invention, was melted, poured, and rolled to about 7:1 reduction to form a 43 mm (1.7 in) square bar similar to the experimental ingot of Example C. In the preparation of this melt, the titanium addition was made in the ladle concurrently with the addition of aluminum. The steel from this ingot was spectrographically analyzed and had the following composition:

| | |
|---|---|
| carbon | 0.28 |
| manganese | 0.74 |
| silicon | 0.53 |
| chromium | 0.30 |
| molybdenum | 0.44 |
| aluminum | 0.026 |
| titanium | 0.045 |
| vanadium | 0.098 |
| boron | 0.0011 |
| oxygen | 0.002 |
| nitrogen | 0.010 |
| iron | essentially balance |

After rolling, three 25.4 mm (1 in) diameter short rod fracture toughness test specimens were machined from bar in accordance with ASTM E1304 having L-T orientation as described in ASTM E399. The fracture toughness test specimens were heat treated according to the above defined quench and temper operation to obtain a fully martensitic microstructure, tested in accordance with ASTM E1304 and found to have the following properties:

| | |
|---|---|
| Hardness $R_C$ | 49 |
| Fracture Toughness $K_{1V}$ | 177 MPa (161 ksi) |

In each of Examples D, E, and F, Hardness measurements were made on each of the test specimens at a point about 12.7 mm (0.5 in) below the grip slot face end of the short rod specimens. The fracture toughness value was calculated as the average value of the three short rod specimens tested. Fracture surfaces from the fracture surfaces of short rod fracture toughness specimens were examined by SEM (scanning electron microscope) techniques. No aluminum nitrides were observed in any specimen. The fracture surfaces all showed predominantly large ductile primary voids having a diameter approximately in the range of about 20 $\mu$ to about 30 $\mu$ surrounding the titanium nitride cuboids and relatively coarse ductile dimples spaced in the range of about 1.0 nanometers to about 1.5 nanometers, and mostly at about 1.2 nanometers.

FIG. 1 shows the fracture surface of the deep hardening steel embodying the present invention. The fracture surface is primarily coarse primary voids and ductile dimples which leads to the high fracture toughness. As shown in FIG. 1, the primary voids of the deep hardening steel embodying the present invention grow around titanium nitride cuboids. FIG. 1 shows that titanium nitride cuboids in the deep hardening steel embodying the present invention are in the 7 $\mu$m to 18 $\mu$m cube edge size range. In addition the spacing between titanium nitride cuboids is about 40 $\mu$m to about 50 $\mu$m for the hardening steel embodying the present invention. The primary void region surrounding the titanium nitride cuboids is in the range of about 30 $\mu$m to about 40 $\mu$m in diameter for the deep hardening steel embodying the present invention. The ductile dimples are present and spaced apart in the range of about 1.0 nanometers to about 1.5 nanometers.

To assure sufficient hardenability and yet not adversely affect toughness properties, carbon should be present, in the composition of the steel embodying the present invention, in a range of from about 0.20% to about 0.45%, by weight, and preferably from about 0.26% to 0.31%, by weight.

The subject deep hardening steel also requires manganese in an amount of at least 0.40% by weight, and no more than 1.50%, by weight to prevent formation of iron sulfides and also to enhance hardenability.

Chromium may be present in the subject steel composition in an amount no more than 2.00% to provide sufficient temper resistance and hardenability.

The subject steel should contain silicon in an amount of at least 0.50% by weight and no more than 2.00% by weight to provide temper resistance and hardenability.

Molybdenum should also be present in the subject steel composition in an amount of at least 0.15% by weight to further assure temper resistance and hardenability, as well as, contribute to small background precipitates. No more than 1.20% by weight is needed to assure that the values of these properties will be beneficially high.

It is also desirable that a small amount of vanadium be included in the composition of the subject steel composition to further promote temper resistance, secondary hardening, and background precipitates. For this purpose, vanadium should be present in amounts of at least 0.01%, and preferably about 0.10%, by weight. The beneficial contribution of vanadium is accomplished with the presence of no more than 0.40%, preferably about 0.10%, by weight, in the steel.

Boron may be present in amount of at least 0.0001%, preferably about 0.002%, by weight, to enhance hardenability, contribute to background precipitates, and reduce grain boundary energy.

Oxygen should be present in the subject steel composition in an amount of 0.002% or less and preferable less than 0.001%. When combined with aluminum, oxygen provides nucleation sites for titanium nitride cuboids in the melt.

The steel composition embodying the present invention must have small, but essential, amounts of both aluminum and titanium. Furthermore, as described above in Example C, it is imperative that the addition of titanium be made to the melt concurrent with, or after, the addition of aluminum to prevent the formation of undesirable aluminum nitrides. At least about 0.005% aluminum and about 0.01% titanium is required to provide beneficial amounts of these elements.

Titanium nitrides contribute to primary voids and carbonitrides contribute to the beneficial fine scale background precipitates. To assure the desirable interactions of these elements with oxygen, and particularly with nitrogen, aluminum should be present in an amount no greater than 0.05%, and preferably about 0.025%, by weight, and titanium should be present in an amount no greater than 0.25%, preferably about 0.05%, by weight.

To assure that there is sufficient nitrogen to combine with titanium and vanadium to form titanium and vanadium nitrides and carbonitrides, it is extremely important that at least 0.002% nitrogen, by weight, is present in the steel composition. Preferably the nitrogen content is between about 0.008% and 0.013%, by weight.

Also, it is desirable that levels of oxygen less than 0.002% by weight, be maintained.

The above examples demonstrate that a significant increase in fracture toughness of deep hardening steel can be achieved by the controlled addition of relatively small, but essential, amounts of aluminum, vanadium and titanium. The mechanism by which the relatively small amounts of these elements beneficially cooperate to refine the microstructure and improve toughness, without a decrease in hardness is described in Example C. The deep hardening steel composition embodying the present invention is essentially free of any detrimental aluminum nitrides.

Industrial Applicability

The steel composition of the present invention is particularly useful in applications requiring tools that are subject to severe wear, or abrasion, and are also subject to breakage. Examples of such tools include ground engaging implements used in construction, such as bucket teeth, ripper tips, and track shoes.

Further, the deep hardening steel described herein is economical to produce and does not require relatively high amounts, i.e., more than 2% chromium nor the inclusion of nickel or cobalt in the composition. Further, the deep hardening steel embodying the present invention responds to conventional quenching and tempering operations. Articles formed of this material do not require specialized equipment or heat treatment to provide high hardness, fracture toughness, and temper resistance in the treated article.

Other aspects, features, and advantages of the present invention can be obtained from a study of this disclosure and drawings, together with the appended claims.

We claim:

1. A steel article having a composition by weight percent, comprising:

from 0.20 to 0.45 carbon, from 0.4 to 1.5 manganese, from 0.5 to 2.0 silicon, from 0.01 to 2.0 chromium, from 0.15 to 1.2 molybdenum, from 0.01 to 0.4 vanadium, from 0.01 to 0.25 titanium, from 0.005 to 0.05 aluminum, from 0.0001 to 0.010 boron, less than 0.002 oxygen, from 0.005 to about 0.017 nitrogen, and the balance essentially iron, said steel article being free of any detrimental aluminum nitride and having been quenched and tempered to produce a fully martensitic microstructure and a controlled distribution of spaced-apart $\mu$ sized titanium nitride cuboids nanometer sized background carbonitride precipitates.

2. A steel article, as set forth in claim 1, wherein said composition comprises, by weight percent, 0.26 to 0.33 carbon, 0.4 to 1.0 manganese, 0.50 to 1.2 silicon, 0.01 to 1.5 chromium, 0.2 to 0.6 molybdenum, 0.05 to 0.12 vanadium, 0.03 to 0.07 titanium, 0.015 to 0.025 aluminum, less than 0.001 oxygen, 0.0001 to 0.005 boron, 0.008 to 0.013 nitrogen, and the balance essentially iron.

3. A steel article, as set forth in claim 2, wherein said steel article after quenching and tempering has a hardness of at least $R_c$ 45 at the middle of a section having a thickness of no more than 25.4 mm (1 inch), and a plane strain fracture toughness of at least 150 MPa (136 ksi).

4. A steel article, as set forth in claim 2, wherein said steel article after quenching and tempering, has a hardness of at least $R_c$ 45 measured at 12.7 mm (0.5 inch) below a surface of a section having a thickness greater than 25.4 mm (1 inch), and a plane strain fracture toughness of at least 150 MPa (136 ksi).

5. A steel article, as set forth in claim 1, wherein said titanium nitride cuboids have a size in the range of about 7 $\mu$m to about 18 $\mu$m cube edge.

6. A steel article, as set forth in claim 1, wherein the spacing between said titanium nitride cuboids is in the range of about 40 $\mu$m to about 50 $\mu$m.

7. A steel article, as set forth in claim 1, wherein said titanium nitride cuboids are surrounded by a primary void region.

8. A steel article, as set forth in claim 7, where said titanium nitride cuboids are surrounded by a primary void region having a rough diameter size in the range of about 30 $\mu$m to about 40 $\mu$m.

9. A steel article, as set forth in claim 1, wherein ductile dimples are spaced-apart in the range of about 1.0 nanometers to about 1.5 nanometers.

10. A steel article having a composition comprising, by weight percent, from 0.20 to 0.45 carbon, from 0.4 to 1.5 manganese, from 0.50 to 2.0 silicon, from 0.01 to 2.0 chromium, from 0.15 to 1.20 molybdenum, from 0.01 to 0.40 vanadium, from 0.01 to 0.25 titanium, from 0.005 to 0.05 aluminum, from 0.0001 to 0.010 boron, less than 0.002 oxygen, from 0.002 to 0.017 nitrogen, and the balance essentially iron, said steel having, after quenching and tempering, a hardness of at least $R_c$ 45 measured at the middle of a section having a thickness of no more than 25.4 mm (1 inch), and a plane strain fracture toughness of at least 150 MPa (136 ksi).

11. A steel article, as set forth in claim 10, wherein said steel article is free of any detrimental aluminum nitride and having, after quenching and tempering, a fully martensitic microstructure and a controlled distribution of spaced apart $\mu$ size titanium nitride cuboids and nanometer size background carbonitride precipitates.

12. A steel article, as set forth in claim 11, wherein said titanium nitride cuboids have a size in the range of about 7 $\mu$m to about 18 $\mu$m cube edge.

13. A steel article, as set forth in claim 11, wherein the spacing between said titanium nitride cuboids is in the range of about 40 $\mu$m to about 50 $\mu$m.

14. A steel article, as set forth in claim 11, wherein said titanium nitride cuboids are surrounded by a primary void region.

15. A steel article, as set forth in claim 14, where said titanium nitride cuboids are surrounded by a primary void region having a rough diameter size in the range of about 30 $\mu$m to about 40 $\mu$m.

16. A steel article, as set forth in claim 11, wherein said ductile dimples are spaced apart in the range of about 1.0 nanometers to about 1.5 nanometers.

17. A steel article, as set forth in claim 10, wherein said composition comprises, by weight percent, 0.26 to 0.33 carbon, 0.4 to 1.0 manganese, 0.50 to 1.2 silicon, 0.01 to 1.5 chromium, 0.2 to 0.6 molybdenum, 0.05 to 0.12 vanadium, 0.03 to 0.07 titanium, 0.005 to 0.025 aluminum, less than 0.001 oxygen, 0.0001 to 0.005 boron, 0.008 to 0.013 nitrogen, and the balance essentially iron.

* * * * *